US007441548B1

(12) United States Patent
Onishi et al.

(10) Patent No.: US 7,441,548 B1
(45) Date of Patent: Oct. 28, 2008

(54) FUEL SUPPLY APPARATUS

(75) Inventors: Yoshihiko Onishi, Tokyo (JP); Satoshi Kusumoto, Tokyo (JP); Shinya Nose, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 11/843,762

(22) Filed: Aug. 23, 2007

(30) Foreign Application Priority Data

Apr. 4, 2007 (JP) ..... 2007-098248

(51) Int. Cl.
*F02M 37/04* (2006.01)
*F02M 37/08* (2006.01)

(52) U.S. Cl. ..... 123/509; 123/469

(58) Field of Classification Search ..... 123/509, 123/468, 469, 446, 514, 516, 518, 519, 520, 123/456, 495; 417/423.1, 423.7, 366, 357, 417/371

See application file for complete search history.

(56) References Cited

U.S. PATENT DOCUMENTS 5,740,784 A * 4/1998 McKinney ..... 123/509
5,913,294 A * 6/1999 Takahashi et al. ..... 123/198 DB
6,622,708 B2 * 9/2003 Braun et al. ..... 123/516
6,698,401 B2 * 3/2004 Suzuki et al. ..... 123/516
6,918,380 B2 * 7/2005 Nomura ..... 123/495
2002/0083923 A1 * 7/2002 Suzuki et al. ..... 123/464
2002/0100457 A1 * 8/2002 Sakai ..... 123/461
2004/0003796 A1 * 1/2004 Nomura ..... 123/461

FOREIGN PATENT DOCUMENTS

JP 8-312485 A 11/1996
JP 2002-227735 A 8/2002

* cited by examiner

*Primary Examiner*—Mahmoud Gimie
(74) *Attorney, Agent, or Firm*—Sughrue Mion, PLLC

(57) ABSTRACT

A fuel supply apparatus particularly for the outboard motor is capable of decreasing the need to change the layout, etc., according to the specification of an engine to reduce the cost of production by preventing vapor from being discharged into an intake pipe. A low pressure fuel pump has its discharge flow rate adjusted to be greater than that of a high pressure fuel pump, and surplus fuel accumulating in a volumetric chamber is caused to circulate through the volumetric chamber, a first return passage, fuel piping, and an inflow passage under the action of the low pressure fuel pump, a check valve and a relief valve, whereby fuel remaining in the volumetric chamber is prevented from being locally warmed.

10 Claims, 4 Drawing Sheets

FUEL SUPPLY APPARATUS

BACKGROUND OF THE INVENTION

1. Field of the Invention

The present invention relates generally to a fuel supply apparatus, and in particular, to a fuel supply apparatus for an outboard motor.

2. Description of the Related Art

Generally, in an outboard motor, the interior of fuel piping that extends from the inside of an inboard fuel tank to the outboard motor is not allowed to be pressurized. Thus, fuel is first drawn up to the outboard motor by a low pressure fuel pump installed in the outboard motor, and is then pressurized by a high pressure fuel pump arranged in the outboard motor, so that the pressurized or high pressure fuel is supplied to a fuel injector unit. However, most of the inner space defined in the outboard motor is occupied by the engine itself. So in cases where the engine is stopped after warm-up operation, vapor which is bubbles of the evaporated fuel can be generated in the fuel in the fuel passages extending in the outboard motor up to the high pressure fuel pump due to the heat of the engine. If the high pressure fuel pump suctions in a large amount of vapor thus generated, vapor lock will occur. Vapor lock is a phenomenon in which vapor enters the fuel pump where it cannot be pressurized and the fuel cannot be discharged.

As a countermeasure against vapor lock, there is one described in a first patent document (Japanese patent application laid-open No. H8-312485). FIG. 7 is a piping diagram that shows a known fuel supply apparatus in an outboard motor. In this figure, a fuel tank 1 disposed on the bottom of a boat is connected to a low pressure fuel pump 3 disposed in a casing 2 of an outboard motor through fuel piping 4. The low pressure fuel pump 3 is connected to a volumetric chamber 6 through an inflow passage 5. A needle valve 8 cooperating with a float 7, a filter 9 and a Westco type high pressure fuel pump 10 are arranged in the volumetric chamber 6. The needle valve 8 is adapted to be opened and closed in accordance with the amount of fuel in the volumetric chamber 6 so as to adjust the fuel therein to a predetermined amount. The high pressure fuel pump 10 has a fuel pressure holding valve 10*a* attached thereto, which is adapted to be opened when the fuel discharge pressure becomes higher than the pressure in a high pressure passage 11 by a predetermined value or more. The high pressure fuel pump 10 is connected to a fuel injector unit 12 through the high pressure passage 11 and serves to pressurize the fuel in the volumetric chamber 6 thereby to supply it to the fuel injector unit 12. The fuel injector unit 12 injects the high pressure fuel thus supplied into an intake pipe 13 of the unillustrated engine in the casing 2. The operations of the high pressure fuel pump 10 and the fuel injector unit 12 are controlled by a drive unit 14. A pressure regulator 16 is connected to the high pressure passage 11 through a drain passage 15. The pressure regulator 16 is connected to the volumetric chamber 6 through a return passage 17, so that when the pressure in the high pressure passage 11 becomes equal to or higher than a predetermined value, the pressure regulator 16 is opened to permit the high pressure fuel in the high pressure passage 11 to return to the volumetric chamber 6, thereby adjusting the pressure in the high pressure passage 11 in an appropriate manner. At an upper location of the volumetric chamber 6, there is arranged a vapor discharge passage 19 that is in communication with the intake pipe 13 through a canister 18. The vapor accumulating in the upper location of the volumetric chamber 6 is collected in the canister 18 and is discharged to the intake pipe 13 upon starting of the unillustrated engine. That is, in this example, the volumetric chamber 6, the float 7, the needle valve 8, the canister 18, and the vapor discharge passage 19 together constitute a vapor liquid separation mechanism 20 that adjusts the vapor in the volumetric chamber 6 to a predetermined amount.

Next, FIG. 8 is a piping diagram that shows another known fuel supply apparatus for an outboard motor. As shown in this figure, a high pressure fuel pump 10 may be arranged outside of a volumetric chamber 6. In this case, the high pressure fuel pump 10 is connected to the volumetric chamber 6 through an outflow passage 21.

In the known fuel supply apparatuses of the outboard motors as described above, the amount of vapor generated changes depending on the amount of heat generated by the engine and the layout of the vapor liquid separation mechanism 20. Thus, variation is caused in the Air/Fuel mixture at the time of engine starting due to a change in the amount of vapor discharged into the intake pipe 13. In other words, in the known apparatuses, vapor is discharged into the intake pipe 13, so it is necessary to change the layout, etc., of the apparatus according to the specification of the engine so as to keep variations in the mixture to a small level, thus resulting in high costs due to an increase in the layout variation etc.

SUMMARY OF THE INVENTION

Accordingly, the present invention is intended to obviate the problems as referred to above, and has for its object to provide a fuel supply apparatus which is capable of decreasing the need to change the layout, etc., according to the specification of an engine to reduce the cost of production by preventing vapor from being discharged into an intake pipe.

Bearing the above object in mind, a fuel supply apparatus according to the present invention includes: a volumetric chamber that is arranged in a casing of an outboard motor; a low pressure fuel pump that is connected to a fuel tank arranged outside of the casing through fuel piping, and at the same time to the volumetric chamber through an inflow passage so as to supply fuel from the fuel tank to the volumetric chamber; a first one-way valve that is arranged in the inflow passage so as to allow fuel to flow from the low pressure fuel pump to the volumetric chamber; a first return passage that has one end connected to the volumetric chamber and the other end connected to the fuel piping in the casing; a second one-way valve that is arranged in the first return passage so as to allow fuel to flow from the volumetric chamber to the fuel piping; and a high pressure fuel pump that has a fuel pressure holding valve which is opened when a fuel discharge pressure becomes equal to or more than a predetermined value, and supplies the fuel in the volumetric chamber to a high pressure passage connected to a fuel injector unit. The low pressure fuel pump has its discharge flow rate adjusted to be greater than that of the high pressure fuel pump, and surplus fuel accumulating in the volumetric chamber is caused to circulate through the volumetric chamber, the first return passage, the fuel piping and the inflow passage under the action of the low pressure fuel pump and the first and second one-way valves.

According to the fuel supply apparatus of the present invention, the discharge flow rate of the low pressure fuel pump is adjusted to be greater than that of the high pressure fuel pump, and surplus fuel accumulating in the volumetric chamber is caused to circulate through the volumetric chamber, the first return passage, the fuel piping and the inflow passage under the action of the low pressure fuel pump and the first and second one-way valves. As a result, it is possible to prevent the fuel remaining in the volumetric chamber from being locally warmed or heated, whereby the temperature of fuel can be made uniform, thus making it possible to reduce the amount of vapor generation. Accordingly, the need to discharge the vapor to the intake pipe can be eliminated, and hence it is possible to reduce the need to change the layout, etc., of the apparatus according to the specification of the engine, thus making it possible to reduce the cost of production.

The above and other objects, features and advantages of the present invention will become more readily apparent to those skilled in the art from the following detailed description of preferred embodiments of the present invention taken in conjunction with the accompanying drawings.

DESCRIPTION OF THE PREFERRED EMBODIMENTS

Hereinafter, preferred embodiments of the present invention will be described in detail while referring to the accompanying drawings.

Embodiment 1

Figure 1:
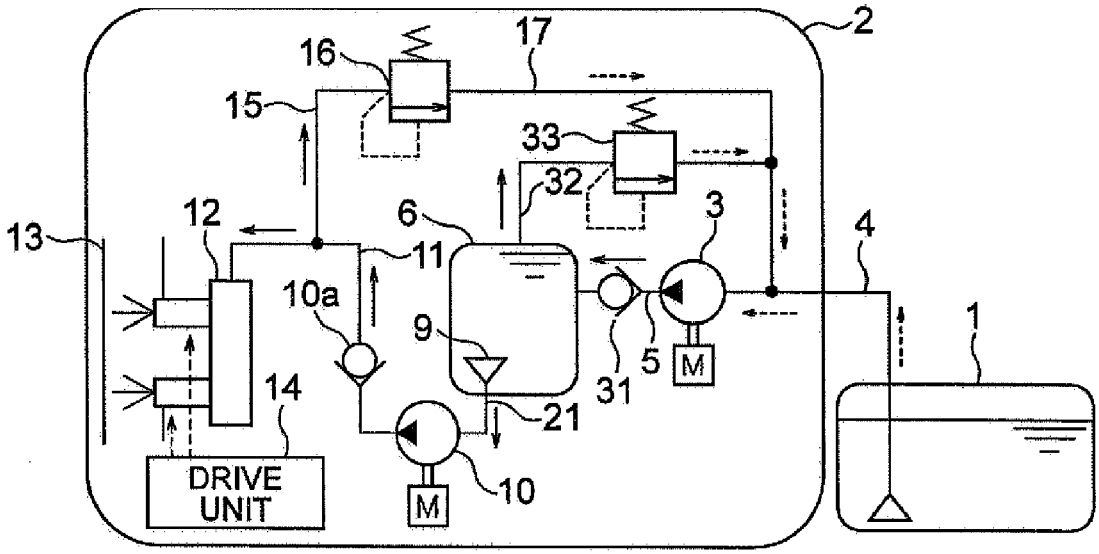
FIG. 1 is a piping diagram showing a fuel supply apparatus according to a first embodiment of the present invention.
Figure 2:
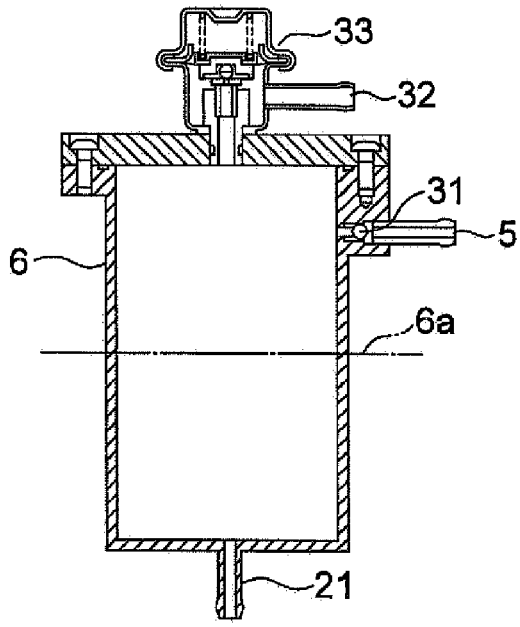
FIG. 2 is a cross sectional view of the volumetric chamber of FIG. 1.

Referring to the drawings and first to FIG. 1, therein is shown, in a piping diagram, a fuel supply apparatus according to a first embodiment of the present invention. FIG. 2 is a cross sectional view of the volumetric chamber 6 in FIG. 1. Here, note that portions of this embodiment that are the same as or correspond to those of the above-mentioned known fuel supply apparatus will be explained by using the same reference numerals and characters. In these figures, a fuel tank 1 disposed on the bottom of a boat is connected to a low pressure fuel pump 3 disposed in a casing 2 of an outboard motor through fuel piping 4. The low pressure fuel pump 3 is connected to a volumetric chamber 6 through an inflow passage 5 and serves to draw up fuel from the fuel tank 1 into the volumetric chamber 6. A first one-way valve in the form of a check valve 31, which allows fuel to flow from the low pressure fuel pump 3 to the volumetric chamber 6, is arranged in the inflow passage 5. A first return passage 32 and an outflow passage 21 other than the inflow passage 5 are connected to the volumetric chamber 6. As shown in FIG. 2, the inflow passage 5 is connected to the volumetric chamber 6 at a location above a heightwise or vertical center 6*a* thereof. The first return passage 32 is connected to an upper surface of the volumetric chamber 6 above the inflow passage 5. The outflow passage 21 is connected to a bottom surface of the volumetric chamber 6 below the heightwise center 6*a* thereof.

Returning to FIG. 1, the first return passage 32 is connected at its one end to the fuel piping 4 in the casing 2. A second one-way valve in the form of a relief valve 33, which serves to allow fuel to flow from the volumetric chamber 6 to the fuel piping 4, is arranged in the first return passage 32. The relief valve 33 is opened when the pressure in the volumetric chamber 6 becomes greater than the pressure in the fuel piping 4 by a predetermined value or more.

A filter 9 is arranged on the bottom location of the volumetric chamber 6, and is attached to one end of the outflow passage 21. The outflow passage 21 is connected at its other end to a high pressure fuel pump 10. The high pressure fuel pump 10 has a fuel pressure holding valve 10*a* attached thereto, which is adapted to be opened when the fuel discharge pressure becomes higher than the pressure in a high pressure passage 11 by a predetermined value or more. The high pressure fuel pump 10 is connected to a fuel injector unit 12 through the high pressure passage 11, and serves to pressurize the fuel in the volumetric chamber 6 and to supply it to the fuel injector unit 12. The fuel injector unit 12 injects the high pressure fuel thus supplied into an intake pipe 13 of the unillustrated engine in the casing 2. The operation of the fuel injector unit 12 is controlled by a drive unit 14.

A pressure regulator 16 is connected to the high pressure passage 11 through a drain passage 15 that branches from the high pressure passage 11. The pressure regulator 16 is connected to the first return passage 32 through a second return passage 17, so that when the pressure in the high pressure passage 11 becomes equal to or higher than a predetermined value such as for example 300 kPa, the pressure regulator 16 is opened to permit the high pressure fuel in the high pressure passage 11 to return to the first return passage 32, thereby adjusting the pressure in the high pressure passage 11 in an appropriate manner.

Figure 5:
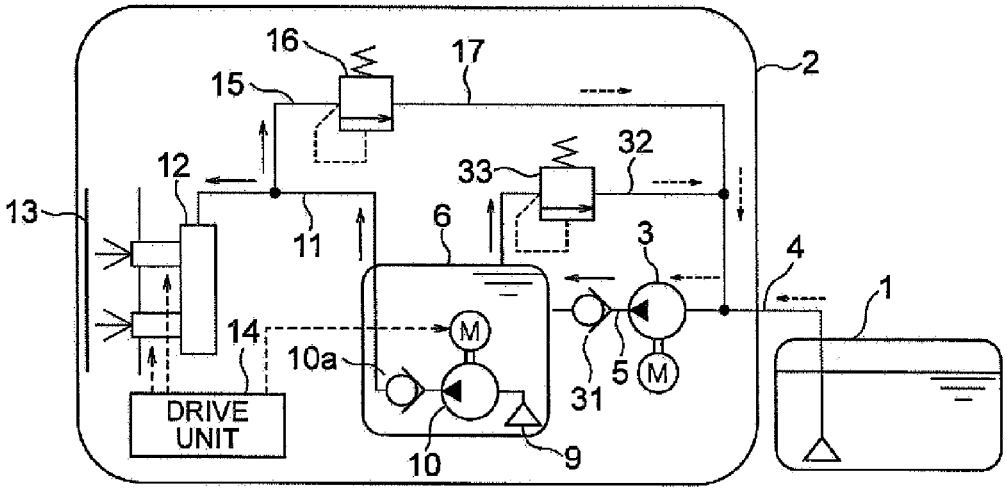
FIG. 5 is a piping diagram showing a fuel supply apparatus according to a third embodiment of the present invention.

Now, the operation of this embodiment will be described below. In this embodiment, the discharge flow rate of the low pressure fuel pump 3 is adjusted to be greater than that of the high pressure fuel pump 10. Thus, an amount of surplus fuel corresponding to the difference between the discharge flow rates of the individual pumps 3, 10 is generated, so the interior of the volumetric chamber 6 is filled with the fuel. This surplus fuel is caused to circulate through the volumetric chamber 6, the first return passage 32, the fuel piping 4, and the inflow passage 5 under the action of the low pressure fuel pump 3, the check valve 31 and the relief valve 33. As a result, the temperature of fuel is made uniform, whereby it is possible to prevent the fuel in the volumetric chamber 6 from being locally warmed or heated by the heat received from the unillustrated engine, and hence the vapor from being generated. In addition, fuel containing vapor is pressurized by the low pressure fuel pump 3 when passing through it, whereby the vapor is dissolved back into the fuel and gradually disappears from the circulating fuel. In this regard, in order to avoid the difference between the flow rates of the low pressure fuel pump 3 and the high pressure fuel pump 10 becoming extreme depending on the operating state of the engine, it is desirable to have the drive sources of the low pressure fuel pump 3 and the high pressure fuel pump 10 be the same. In this embodiment, the low pressure fuel pump 3 and the high pressure fuel pump 10 are mechanically driven by the power of the crankshaft of the engine. A character M enclosed by a square in FIGS. 1, and 6 through 8 shows that the drive source is the power of the crankshaft, whereas a character M enclosed by a circle in FIG. 5, 7 shows that the drive source is a motor. If the drive source is a motor, each pump 3, 10 may also be driven by an individually motor. In the known apparatuses shown in FIGS. 7 and 8, when the needle valve 8 in the vapor liquid separation mechanism 20 is closed, the low pressure fuel pump 3 is turned into a closed state to generate power loss, but such a problem does not occur in this embodiment because the needle valve 8 is omitted.

Figure 3:
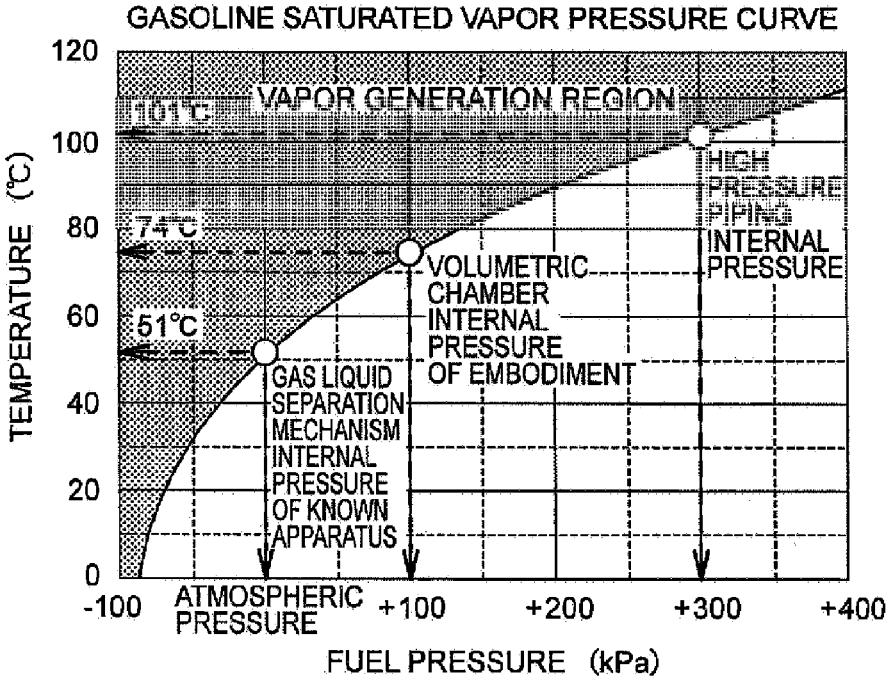
FIG. 3 is a graph showing a gasoline saturated vapor pressure curve.

Here, when the engine is stopped after being warmed up, the temperature of fuel in the volumetric chamber 6 is raised by the heat received from the engine, and vapor is generated when the fuel temperature exceeds the temperature indicated by the gasoline saturated vapor pressure curve shown in FIG. 3. In this embodiment, the relief valve 33 is installed in the first return passage 32, and the pressure in the volumetric chamber 6 is raised by the surplus fuel supplied by the low pressure fuel pump 6, thereby increasing the temperature at which vapor is generated. Here, note that it is necessary to set the valve opening pressure of the relief valve 33 in the form of the fuel pressure to a value at least equal to or less than the valve opening pressure of the pressure regulator 16 so as to prevent the pressure of fuel supplied to the high pressure passage 11 from becoming too high. In this embodiment, from the viewpoint of reducing the amount of generated vapor based on the load of the low pressure fuel pump 3 and the gasoline saturated vapor pressure curve (see FIG. 3), the valve opening pressure of the relief valve 33 is set to such a value as to provide a high vapor generation temperature gradient with respect to the fuel pressure, i.e., a value higher than the atmospheric pressure by 100 kPa.

However, when the engine gets cool, the fuel in the volumetric chamber 6 also becomes cooler to liquefy the vapor therein. When the pressure in the volumetric chamber 6 is reduced due to the liquefaction of the vapor, fuel is supplied to the volumetric chamber 6 from the check valve 31. As a result, it is possible to prevent the pressure in the volumetric chamber 6 from being decreased to atmospheric pressure or below, and at the same time to fill the volumetric chamber 6 with fuel thereby to enable fuel to be supplied to the high pressure fuel pump 10 in a stable manner at the time of engine restart.

The fuel in the volumetric chamber 6 is sucked or drawn into the high pressure fuel pump 10 through the filter 9, pressurized there by the high pressure fuel pump 10, and supplied to the fuel injector unit 12. The pressure of fuel supplied to the fuel injector unit 12 is the pressure in the high pressure passage 11, and this pressure in the high pressure passage 11 is adjusted to a predetermined pressure value by the pressure regulator 16. The fuel discharged from the pressure regulator 16 is returned to the low pressure fuel pump 3 through the first and second return passages 32, 17. Here, note that the pressure in the volumetric chamber 6 changes, so the operation of the pressure regulator 16 becomes unstable where the first return passage 32 is connected to the volumetric chamber 6, as in the known apparatus shown in FIG. 7. In this embodiment, the first return passage 32 is connected to the second return passage 17, so the pressure on the discharge side of the pressure regulator 16 always becomes atmospheric pressure, and hence the operation of the pressure regulator 16 is steady, thus stabilizing the pressure in the high pressure passage 11.

In this regard, it is necessary to arrange the Westco type fuel pump used in the known apparatus (see FIG. 7) in the volumetric chamber 6 due to its poor self-priming capability, so the volumetric chamber is increased in size. In addition, when the pressure in the volumetric chamber changes, the discharge flow rate of fuel from the volumetric chamber is caused to change. In this embodiment, a piston type fuel pump, which can be installed in the fuel piping, has excellent self-priming capability, and is less prone to generate variations in the discharge flow rate thereof even if the suction pressure thereof changes, is adapted as the high pressure fuel pump 10. As a result, the entire outboard motor can be reduced in size.

In such a fuel supply apparatus, the discharge flow rate of the low pressure fuel pump 3 is adjusted to be greater than that of the high pressure fuel pump 10, and the surplus fuel accumulating in the volumetric chamber 6 is caused to circulate through the volumetric chamber 6, the first return passage 32, the fuel piping 4, and the inflow passage 5 under the action of the low pressure fuel pump 3, the check valve 31 and the relief valve 33. Thus, it is possible to prevent the fuel remaining in the volumetric chamber 6 from being locally warmed or heated, whereby the temperature of fuel in the volumetric chamber 6 can be made uniform, thus making it possible to reduce the amount of vapor generation. Accordingly, the need to discharge the vapor to the intake pipe 13 can be eliminated, and hence, it is possible to reduce the need to change the layout, etc., of the apparatus depending on the specification of the engine, thus making it possible to reduce the cost of production. In addition, the fuel containing vapor is pressurized by the low pressure fuel pump 3 during passage therethrough, so the vapor can be dissolved back into the fuel, and hence reduced from the circulating fuel.

Moreover, in the known apparatus, a needle valve 8, a canister 18 (see FIG. 7) and the like are used, so the structure of the gas liquid separation mechanism 20 becomes complicated and the size thereof is increased. The increased size of the vapor liquid separation mechanism 20 results in an increase in the size of the entire outboard motor, as well. In contrast, according to the fuel supply apparatus of this embodiment, large sized components such as the canister 18, etc., are omitted, and hence the size of the apparatus can be reduced. That is, the fuel supply apparatus of the present invention is particularly effective for outboard motor of small displacement.

In addition, the relief valve 33 is installed in the first return passage 32, so that the pressure in the volumetric chamber 6 can be raised by the surplus fuel supplied by the low pressure fuel pump 3. Accordingly, the temperature at which vapor is generated in the volumetric chamber 6 can be raised, thereby making it possible to reduce the amount of vapor generation.

Further, the second return passage 17 connected to the pressure regulator 16 is connected to the first return passage 32 in the casing 2, so the discharge side pressure of the pressure regulator 16 can be brought to atmospheric pressure at any time. Thus, the valve-opening operation of the pressure regulator 16 can be stabilized, whereby the pressure of fuel supplied to the fuel injector unit 12 can be stabilized.

Furthermore, the valve opening pressure of the relief valve 33 is higher than atmospheric pressure by 100 kPa and is lower than the valve opening pressure of the pressure regulator 16. Accordingly, the amount of vapor generated in the volumetric chamber 6 can be decreased in an effective manner, and it is possible to prevent the pressure in the high pressure passage 11 from becoming too high.

In addition, the inflow passage 5 is connected to the volumetric chamber 6 at a location above the heightwise center **6*a* of the volumetric chamber 6, and the first return passage 32 is connected to the volumetric chamber 6 at a location above the inflow passage 5. With such arrangements, even if vapor is generated in the volumetric chamber 6, fuel containing the vapor can be caused to circulate in a more reliable manner, thus making it possible to decrease the vapor in the volumetric chamber 6** in a more reliable manner.

Moreover, the high pressure fuel pump 10 is arranged outside of the volumetric chamber 6, and the outflow passage 21 connected to the high pressure fuel pump 10 is connected to the volumetric chamber 6 at a location below the heightwise center 6*a* thereof. With such arrangements, the possibility of the high pressure fuel pump 10 sucking vapor can be lowered, thereby making it possible to reduce the possibility of vapor lock in a more reliable manner.

Embodiment 2

Figure 4:
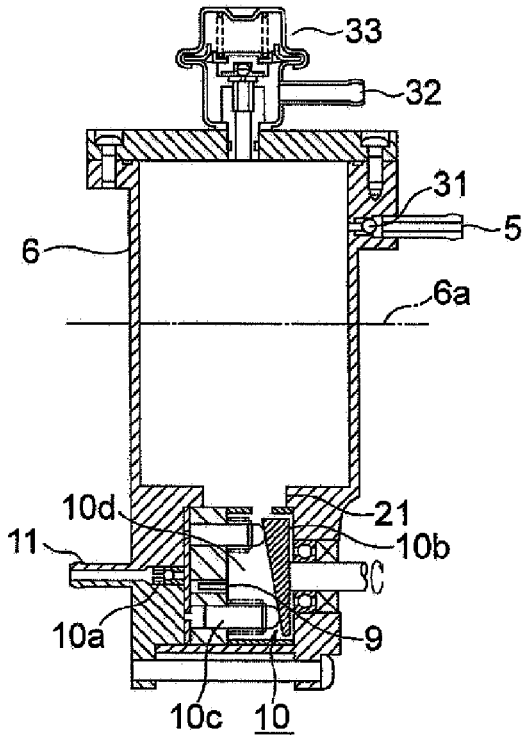
FIG. 4 is a cross sectional view showing essential portions of a fuel supply apparatus according to a second embodiment of the present invention.

FIG. 4 is a cross sectional view that shows essential portions of a fuel supply apparatus according to a second embodiment of the present invention. Here, note that portions of this embodiment that are the same as or correspond to those of the above-mentioned first embodiment will be explained by using the same reference numerals and characters. In this second embodiment, a high pressure fuel pump 10 is formed integrally with a volumetric chamber 6. As shown in this figure, the high pressure fuel pump 10 comprises an axial piston pump in which a plurality of pistons 10*c* are driven to reciprocate by the rotation of a swash plate 10*b*. A fuel reservoir 10*d* with a suction hole having a filter 9 attached thereto being opened therein is in fluid communication with an outflow passage 21 formed in a bottom location of the volumetric chamber 6. The construction of this second embodiment other than the above is similar to that of the first embodiment.

In such a fuel supply apparatus, since the high pressure fuel pump 10 is formed integrally with the volumetric chamber 6, the size of the apparatus as a whole can be reduced, so the apparatus can be applied to outboard motors of small displacement in a more reliable manner.

Embodiment 3

FIG. 5 is a piping diagram that shows a fuel supply apparatus according to a third embodiment of the present invention. Here, note that portions of this embodiment that are the same as or correspond to those of the above-mentioned first and second embodiments will be explained by using the same reference numerals and characters. As shown in this figure, in this third embodiment, a high pressure fuel pump 10 is built into a volumetric chamber 6. In addition, as drive sources for a low pressure fuel pump 3 and the high pressure fuel pump 10, there are used motors that are controlled to be linked to each other by means of a drive unit 14. The construction of this third embodiment other than the above is similar to that of the first embodiment.

In such a fuel supply apparatus, since the high pressure fuel pump 10 is arranged in the volumetric chamber 6, an outflow passage 21 can be omitted, and the possibility of fuel leakage from a connection portion of the outflow passage 21 can be reduced.

Embodiment 4

Figure 6:
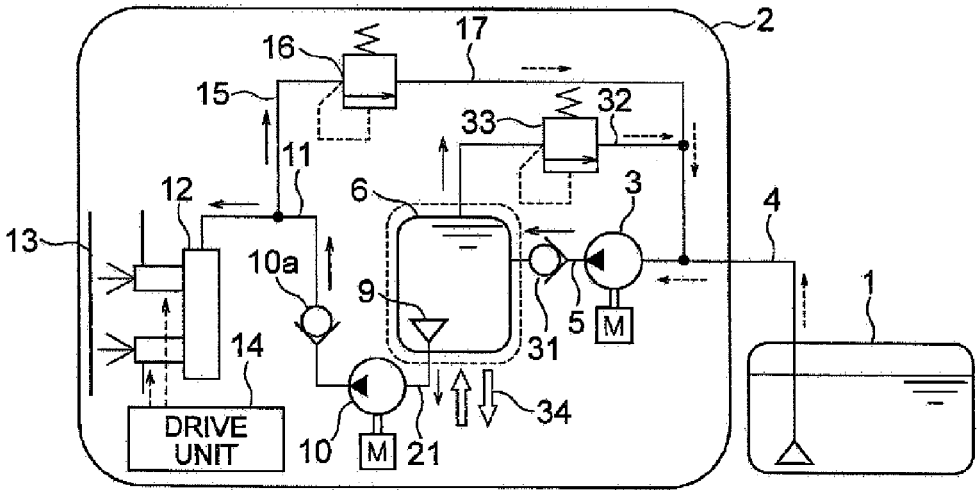
FIG. 6 is a piping diagram showing a fuel supply apparatus according to a fourth embodiment of the present invention.
Figure 7:
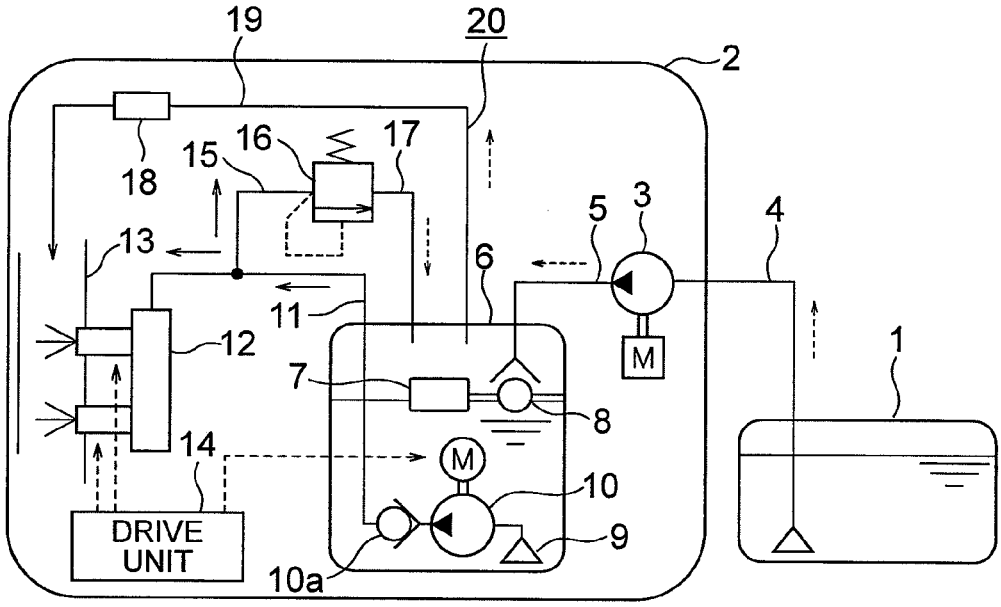
FIG. 7 PRIOR ART
FIG. 7 is a piping diagram showing a known fuel supply apparatus in an outboard motor.
Figure 8:
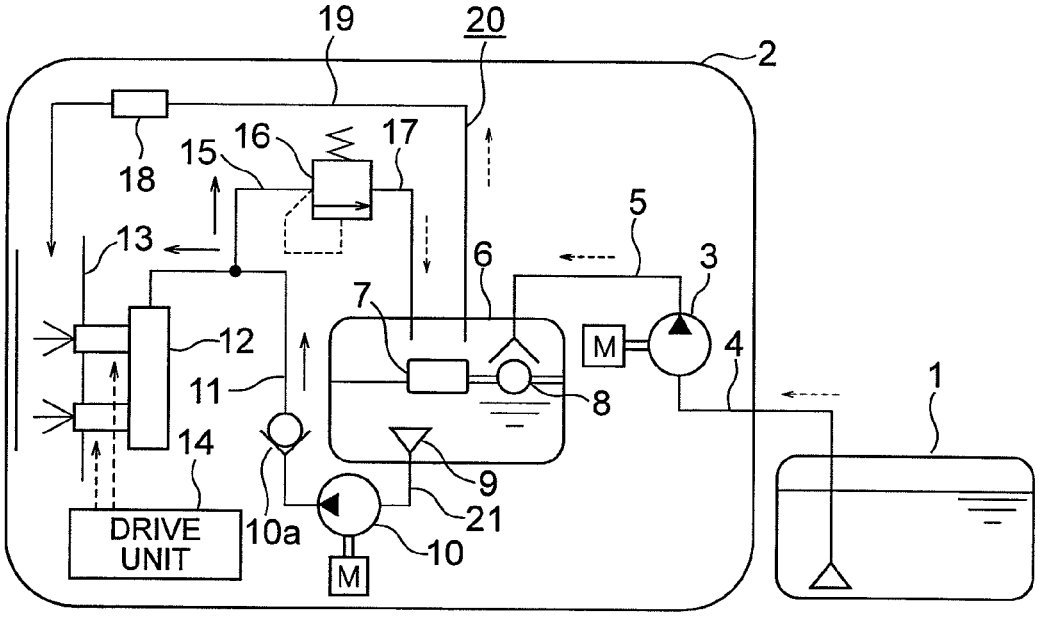
FIG. 8 PRIOR ART
FIG. 8 is a piping diagram showing another known fuel supply apparatus.

FIG. 6 is a piping diagram that shows a fuel supply apparatus according to a fourth embodiment of the present invention. Here, note that portions of this embodiment that are the same as or correspond to those of the above-mentioned first through third embodiments will be explained by using the same reference numerals and characters. As shown in this figure, in this fourth embodiment, a cooling passage 34 is provided in a volumetric chamber 6. Here, note that the cooling passage 34 is a passage in which cooling fluid flows. This passage is arranged in a location in the volumetric chamber 6 which is considered to easily receive heat from the engine.

In such a fuel supply apparatus, since the cooling passage 34 is provided in the volumetric chamber 6, a temperature rise in the volumetric chamber 6 due to the heat received from the engine can be suppressed, thus making it possible to reduce the possibility of vapor generation in the volumetric chamber 6 in a more reliable manner.

Although in the fourth embodiment, the cooling passage 34 has been described as being arranged in the volumetric chamber 6, a similar advantageous effect can be achieved even if a heat insulating member is installed at a location which is considered to easily receive heat from the engine.

In addition, although in the first through fourth embodiments, the relief valve 33 has been described as being arranged in the first return passage 32, surplus fuel can be caused to circulate even if a check valve is used as the second one-way valve. In the case of using the check valve as the second one-way valve, the pressure in the volumetric chamber remains at atmospheric pressure, so the second return passage connected to the pressure regulator may be connected to the volumetric chamber.

While the invention has been described in terms of preferred embodiments, those skilled in the art will recognize that the invention can be practiced with modifications within the spirit and scope of the appended claims.

What is claimed is:

1. A fuel supply apparatus comprising:

a volumetric chamber that is arranged in a casing of an outboard motor;

a low pressure fuel pump that is connected to a fuel tank arranged outside of said casing through fuel piping, and at the same time to said volumetric chamber through an inflow passage so as to supply fuel from said fuel tank to said volumetric chamber;

a first one-way valve that is arranged in said inflow passage so as to allow fuel to flow from said low pressure fuel pump to said volumetric chamber;

a first return passage that has one end connected to said volumetric chamber and the other end connected to said fuel piping in said casing;

a second one-way valve that is arranged in said first return passage so as to allow fuel to flow from said volumetric chamber to said fuel piping; and a high pressure fuel pump that has a fuel pressure holding valve which is opened when a fuel discharge pressure becomes equal to or more than a predetermined value, and supplies the fuel in said volumetric chamber to a high pressure passage connected to a fuel injector unit;

wherein said low pressure fuel pump has its discharge flow rate adjusted to be greater than that of said high pressure fuel pump, and surplus fuel accumulating in said volumetric chamber is caused to circulate through said volumetric chamber, said first return passage, said fuel piping and said inflow passage under the action of said low pressure fuel pump and said first and second one-way valves.

2. The fuel supply apparatus as set forth in claim 1, wherein said second one-way valve is opened when the pressure in said volumetric chamber becomes greater than the pressure in said fuel piping by a predetermined value or more.

3. The fuel supply apparatus as set forth in claim 2, further comprising:

a drain passage that is connected to said high pressure passage;

a pressure regulator that is connected to said high pressure passage through said drain passage, and is opened so as to adjust the pressure in said high pressure passage when the pressure in said high pressure passage becomes equal to or more than a predetermined value; and a second return passage that is connected to said pressure regulator, and at the same time to said first return passage in said casing.

4. The fuel supply apparatus as set forth in claim 3, wherein a valve opening pressure of said second one-way valve is greater than an atmospheric pressure and equal to or less than a valve opening pressure of said pressure regulator.

5. The fuel supply apparatus as set forth in claim 1, wherein said inflow passage is connected to said volumetric chamber at a location above a heightwise center thereof; and said first return passage is connected to said volumetric chamber at a location above said inflow passage.

6. The fuel supply apparatus as set forth in claim 1, further comprising:

an outflow passage that is connected to said high pressure fuel pump;

wherein said high pressure fuel pump is arranged outside of said volumetric chamber, and said outflow passage is connected to said volumetric chamber at a location below said heightwise center thereof.

7. The fuel supply apparatus as set forth in claim 1, wherein said high pressure fuel pump is formed integrally with said volumetric chamber.

8. The fuel supply apparatus as set forth in claim 1, wherein said high pressure fuel pump is built into said volumetric chamber.

9. The fuel supply apparatus as set forth in claim 1, wherein a cooling passage is arranged in said volumetric chamber.

10. The fuel supply apparatus as set forth in claim 1, wherein said low pressure fuel pump is provided in said casing.

* * * * *